United States Patent [19]

Hoffman et al.

[11] 4,226,452

[45] Oct. 7, 1980

[54] LATCH

[75] Inventors: Ronald R. Hoffman, Morgantown; Rex E. Payne, Jr.; David Saint, both of Elverson, all of Pa.

[73] Assignee: Port-A-Crib, Inc., Hallam, Pa.

[21] Appl. No.: 8,629

[22] Filed: Feb. 1, 1979

[51] Int. Cl.[2] ..... E05C 1/04

[52] U.S. Cl. ..... 292/175

[58] Field of Search ..... 292/145, 147, 149, 175, 292/163

[56] References Cited

U.S. PATENT DOCUMENTS

| | | | |
|---|---|---|---|
| 1,496,822 | 6/1924 | Moore | 292/145 X |
| 1,517,447 | 12/1924 | Merz | 292/145 |
| 1,521,572 | 12/1924 | Hammer et al. | 292/149 X |
| 1,794,643 | 3/1931 | Raw | 292/175 |
| 2,514,668 | 7/1950 | Neunherz | 292/175 X |

*Primary Examiner*—Richard E. Moore

*Attorney, Agent, or Firm*—Seidel, Gonda, Goldhammer & Panitch

[57] ABSTRACT

A latch, particularly for a crib or the like, is spring biased to a latched position. A single fastener secures the latch member to a support and guides the latch for reciprocal movement.

10 Claims, 3 Drawing Figures

LATCH

SUMMARY OF THE INVENTION

The latch of the present invention includes a one piece latch member having a tongue on one end for entry into a cavity. The other end of the latch member has a pair of generally parallel arms. The latch member is mounted on a support. The support has a reaction surface generally perpendicular to the surface on which the latch member is mounted. The reaction surface is disposed between the arms on the latch member, thus acting as a guide for the reciprocal movement of the latch member.

A spring means extends between the reaction surface and the latch member. The latch member has a slot elongated in a direction generally perpendicular to the reaction surface. A single fastener extends through said slot. The fastener guides the reciprocal movement of the latch member and secures the latch member to said support. The length of the slot and the length of the arms are proportioned so that the reaction surface is between said arms at all times.

It is an object of the present invention to provide a novel latch which is simple, inexpensive, involves a minimum number of parts, and is reliable.

Other objects will appear hereinafter

For the purpose of illustrating the invention, there is shown in the drawings a form which is presently preferred; it being understood, however, that this invention is not limited to the precise arrangements and instrumentalities shown.

Figure 3:
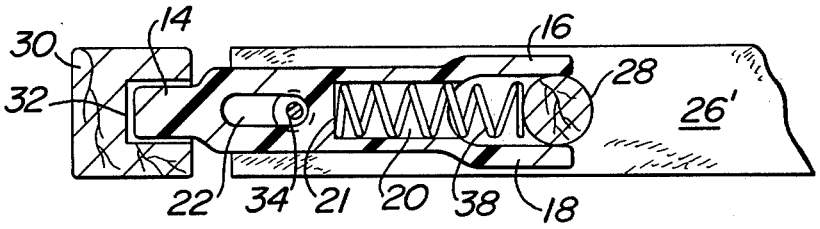
FIG. 3 is a sectional view taken along the line 3—3 in FIG 2.

Referring to the drawings in detail wherein like numerals indicate like elements, there is shown a latch member 10 having a body 12. An integral tongue 14 projects from one end of body 12. At its other end, body 12 has a pair of generally parallel arms 16, 18. As shown more clearly in FIG. 3, the free ends of the arms 16, 18 are spaced apart by a distance slightly greater than the corresponding distance at the end of the arms where they are integral with the body 12.

The body 12 has a recess 20 defined at one end by a wall 21. See FIG. 3. The other end of the recess 20 is contiguous with the space between the arms 16, 18. The body 12 has a slot 22 extending therethrough. The slot 22 is elongated in a direction parallel to the direction of the arms 16, 18.

Figure 1:
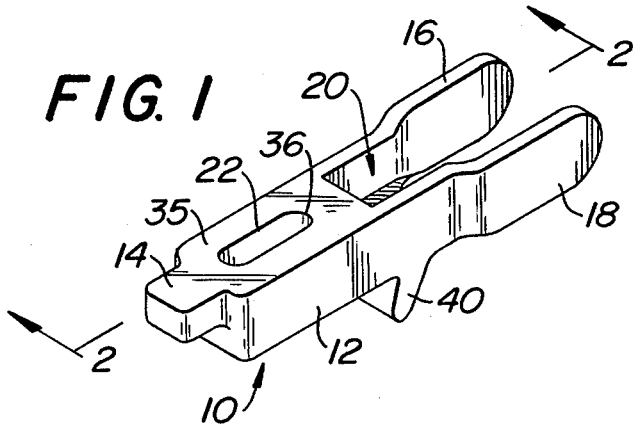
FIG. 1 is a perspective view of a latch member forming a part of the present invention.
Figure 2:
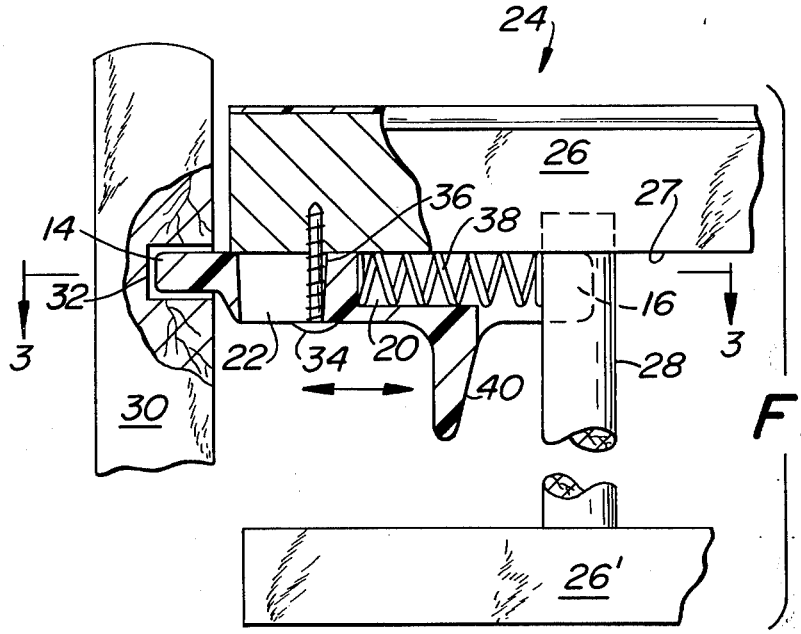
FIG. 2 is an elevation view of the latch of the present invention, with portions in section for purposes of illustration.

As shown in FIG. 2, the latch member 10 is incorporated in a latch in accordance with the present invention and designated generally as 24. The latch 24 includes two elements one of which is movable relative to the other. Latch member 10 may be supported by either the stationary element or the movable element. For purposes of this disclosure, and in accordance with the preferred embodiment of the invention, latch member 10 is supported by the movable element.

As shown more clearly in FIG. 2, the movable element supporting the latch member 10 is a crib fence having an upper rail support 26 and a lower rail support 26'. The rail supports 26, 26' are interconnected at spaced points by a plurality of parallel struts or dowels 28. Only one strut 28 is shown. The stationary element of the latch 24 is post 30. The post 30 has a cavity 32 for receiving the tongue 14. Post 30 may be the front leg of a conventional crib having a conventional movable fence.

A threaded fastener 34 extends through the slot 22. Fastener 34 has a head at its lower end and which overlies a portion of the body 12 on opposite sides of slot 22. Face 35 of body 12 is planar and retained juxtaposed to surface 27 on support 26 by the fastener 34. Fastener 34 also guides the body 12 for reciprocal motion of the latter toward and away from the post 30. The end wall 36 of slot 22 is tapered at an angle of about 3° with respect to the longitudinal axis of fastener 34.

A spring means such as coil spring 38 is disposed in the recess 20 and the space between arms 16, 18. One end of spring 38 contacts end wall 21. The other end of spring 38 contacts a reaction surface on the support 26 such as the strut 28. Due to the angle of wall 36, spring 38 applies a bias force which tends to rotate the latch member in a counterclockwise direction in FIG. 2 thereby assuring contact between arms 16, 18 and surface 27 at the at rest postion. The surface 27 adjacent the slot 22 will be spaced from and out of contact with surface 27.

The length of the slot 22 and the length of the arms 16, 18 are proportioned so that the reaction surface of strut 28 remains between the arms 16, 18 at all times. To facilitate application of finger pressure for overcoming the bias of spring 38 and thereby moving the tongue 14 out of recess 32, the body 12 has a downwardly extending projection 40.

The projection 40 preferably extends downwardly so as to be generally parallel to strut 28. By locating the projection 40 adjacent the strut 28, a person may place one finger of one hand on projection 40 with the thumb on said one hand on strut 28. Thereafter, the person can move the tongue 14 out of cavity 32 by squeezing said finger and thumb toward each other. Thereafter, the support 26 may be pivoted or otherwise moved relative to post 30.

The following advantages of the present invention will be noted. The latch 24 is comprised of a minimum number of components. The latch 24 requires minimal preparation of the support structure. The single fastener 34 performs the multiple functions of securing the latch member 10 to the support 26, of guiding the reciprocal movement of the latch member 10 and for cooperating with wall 36 and spring 38 to cock one end of the latch member 10 against surface 27. The cocking of the latch member 10 minimizes frictional contact between surfaces 27, 35 whereby only the force required to overcome the spring is needed to slide latch member 10. The struts 28 perform the multiple functions of interconnecting the supports 26, 26', of guiding the reciprocal movement of the latch member 10, and act as a reaction surface for the spring 38.

The present invention has reduced the preparation of the crib support structure to the drilling of one hole, namely the hole for fastener 34. This is a definite manufacturing advantage since the hole can be drilled simultaneously with the drilling of the holes for struts or dowels 28 whereby no additional steps are required.

The present invention may be embodied in other specific forms without departing from the spirit or essential attributes thereof and, accordingly, reference should be made to the appended claims, rather than to the foregoing specification, as indicating the scope of the invention.

We claim:

1. A latch comprising a one-piece latch member having a tongue on one end for entry into a cavity, the other end of said member having a pair of generally parallel arms extending therefrom, a support having a reaction surface generally perpendicular to a mounting surface of said support, said reaction surface being between said arms, a spring means extending between said reaction surface and said latch member, said latch member having a slot elongated in a direction generally perpendicular to said reaction surface, a single fastener extending through said slot, said fastener guiding said latch member for reciprocal movement and securing said member to said mounting surface of said support, the length of said slot and the length of said arms being proportioned so that said reaction surface is between said arms at all times and guides said latch member for reciprocal movement, an end wall of said slot disposed at a small angle with respect to the longitudinal axis of said fastener so that said spring biases said latch member into contact with said mounting surface.

2. A latch in accordance with claim 1 wherein said latch member has a recess contiguous at one end with the space between said arms, said spring means extending into said recess.

3. A latch in accordance with claim 1 including a projection on said member to facilitate application of finger pressure to said latch member for overcoming the bias of said spring means.

4. A latch in accordance with claim 1 wherein said support is the top rail of a crib fence, said mounting surface on said rail being a bottom surface thereof, and said latch member having a projection extending downwardly in a direction away from said mounting surface to facilitate application of finger pressure to said latch member.

5. A latch in accordance with claim 1 including a stationary post, said post having a cavity for receiving said tongue, said tongue being biased into said cavity by said spring means, said post being vertically disposed, said mounting surface being horizontally disposed and generally perpendicular to said post, and said reaction surface being vertically disposed and below said support.

6. A latch comprising a one piece latch member having a tongue on one end for entry into a cavity, the other end of said member having a pair of generally parallel arms extending therefrom and terminating at free ends, a support having a reaction surface generally perpendicular to a mounting surface of said support, said reaction surface being between said arms, a spring means extending between said reaction surface and said latch member, said latch member having a recess contiguous at one end with the space between said arms, said spring means extending into said recess, said latch member having a slot elongated in a direction generally parallel to said mounting surface, a single fastener extending through said slot, said fastener guiding said latch member for reciprocal movement and securing said member to said mounting surface of said support, the length of said slot and the length of said arms being proportioned so that said reaction surface is between said arms at all times and guides said latch member for reciprocal movement, a stationary post, said post having a cavity for receiving said tongue, said tongue being biased into said cavity by said spring means, said post being vertically disposed, said mounting surface being horizontally disposed and generally perpendicular to said post, and said reaction surface being vertically disposed and below the elevation of said support.

7. A latch in accordance with claim 6 wherein an end wall of said slot is disposed at a small angle with respect to the longitudinal axis of said fastener, so that said spring biases said latch member into contact with said mounting surface.

8. A latch in accordance with claim 7 wherein said angle is about 3°.

9. A latch in accordance with claim 7 wherein said support is the top rail of a crib fence, said mounting surface on said rail being a bottom surface thereof, and a projection extending downwardly generally parallel to and adjacent said reaction surface.

10. Apparatus comprising a one-piece latch member having a tongue at one end for entry into a cavity, a stationary post having a cavity for receiving said tongue, the other end of said member having a pair of generally parallel arms extending therefrom in a direction away from said post, a crib fence top rail having a strut generally perpendicular to a mounting surface on said top rail and generaly parallel to said post, said strut being between said arms, a spring means extending between said strut and said latch member, said spring means being disposed in the space between said arms, said tongue being biased into said cavity by said spring means, said latch member having a slot elongated in a direction generally parallel to said mounting surface, a single fastener extending through said slot, said fastener guiding said latch member for reciprocal movement and securing said member to said mounting surface of said top rail, the length of said slot and the length of said arms being proportioned so that said strut is between said arms at all times and guide said latch member for reciprocal movement toward and away from said post, said mounting surface being horizontally disposed and generally perpendicular to said post, said strut having one end connected to said top rail.

* * * * *